US005953897A

United States Patent [19]

Wassenhoven et al.

[11] Patent Number: 5,953,897

[45] Date of Patent: Sep. 21, 1999

[54] FIBER GUIDE DEVICE FOR CONNECTING A SLIVER OPENING DEVICE WITH A ROTOR SPINNING HOUSING IN AN OPEN-END SPINNING APPARATUS

[75] Inventors: Heinz-Georg Wassenhoven; Jochen Dressen, both of Moenchengladbach; Dieter Haaken, Erkelenz, all of Germany

[73] Assignee: W. Schlafhorst AG & Co., Moenchengladbach, Germany

[21] Appl. No.: 09/048,153

[22] Filed: Mar. 25, 1998

[30] Foreign Application Priority Data

Mar. 27, 1997 [DE] Germany ..... 197 12 881

[51] Int. Cl.[6] ..... D01H 4/00

[52] U.S. Cl. ..... 57/413; 57/404; 57/406; 57/408; 57/411

[58] Field of Search ..... 57/404, 406, 407, 57/408, 411, 413

[56] References Cited

U.S. PATENT DOCUMENTS

| | | | |
|---|---|---|---|
| 3,956,876 | 5/1976 | Artzt et al. | 57/413 |
| 5,111,651 | 5/1992 | Pohn et al. | 57/413 |
| 5,423,172 | 6/1995 | Furtmeier et al. | 57/407 |
| 5,555,717 | 9/1996 | Schuller et al. | 57/413 |
| 5,685,137 | 11/1997 | Raasch | 57/413 |

FOREIGN PATENT DOCUMENTS

| | | |
|---|---|---|
| 23 64 261 A1 | 6/1975 | Germany . |
| 28 00 795 A1 | 7/1979 | Germany . |
| 29 47 294 A1 | 5/1980 | Germany . |
| 32 05 303 A1 | 9/1982 | Germany . |
| 39 23 060 A1 | 1/1991 | Germany . |
| 195 11 084 | 3/1995 | Germany . |

*Primary Examiner*—William Stryjewski
*Attorney, Agent, or Firm*—Kennedy Covington Lobdell & Hickman, LLP

[57] ABSTRACT

An open-end spinning apparatus (1) has a spinning rotor (4) rotating in a vacuum-applied rotor housing (2) closed by a conduit plate (37) with a sliver opening device (51) delivering individualized spinning fibers into the rotor housing through a fiber guide conduit device (14) connecting the sliver opening device (51) to the conduit plate (37). The fiber guide conduit device (14) is replaceably supported in a connection bore (31) of the sliver opening housing (17). The fiber guide conduit device (14) is a cast part comprising a fiber guide conduit body (43) with a position fixing device (34) to assure a given mounting position with respect to the opening housing, a cylindrical foot having a groove (36) receiving an O-ring (35) for sealing with respect to the opening housing, and a contact shoulder (41) to support a hose nozzle (38) for sealing with respect to the conduit plate.

10 Claims, 3 Drawing Sheets

FIBER GUIDE DEVICE FOR CONNECTING A SLIVER OPENING DEVICE WITH A ROTOR SPINNING HOUSING IN AN OPEN-END SPINNING APPARATUS

BACKGROUND OF THE INVENTION

The present invention relates generally to an open-end spinning apparatus and, more particularly, to a fiber guide device for connecting a sliver opening device with a rotor spinning housing in an open-end spinning apparatus.

Open-end spinning apparatus are well known within the textile industry as disclosed in numerous publications. For example, German Patent Publications DE 28 00 795 A1 or DE 195 11 084 A1 describe open-end spinning apparatus with sliver opening devices in which a sliver intermediately stored in a sliver can is presented to a rotating opening cylinder which opens the sliver into individual fibers. The individual fibers are subsequently supplied via a one-piece fiber guide conduit to a spinning rotor rotating in a rotor housing at a high speed wherein the fibers are twisted in an internal rotor groove continuously onto the end of a yarn leaving the spinning rotor via a withdrawal device. The finished yarn is subsequently wound at an associated spooling or winding device into a cross-wound bobbin.

Significant requirements are placed on the design of the fiber guide conduit in which the individual fibers are transported from the opening cylinder to the spinning rotor, e.g. as regards the geometric design or the surface quality. That is, the flow conditions inside the fiber guide conduit must assure that the fibers are held stretched or are stretched during transport. Moreover, the surface of this component must be smooth throughout in order that no fibers can settle or become clogged during the pneumatic transport of the fibers. It should also be avoided that damaging air vortices develop in the boundary layer area of the fiber guide conduit.

The fiber guide conduit devices are made of sheet steel parts both in the open-end spinning apparatus described in German Patent Publication DE 28 00 795 A1 and in the open-end spinning apparatus according to German Patent Publication DE 195 11 084 A1. German Patent Publication DE 23 64 261 A1 also shows similar fiber guide conduit devices made of steel sheeting.

German Patent Publication DE 28 00 795 A1 discloses the manufacture of a fiber guide conduit device by initially fabricating the device from a steel sheet. Then liquid aluminum, for example, is subsequently cast around this prefabricated component in a diecasting tool with an inner form designed as an opening-cylinder housing.

However, such a manufacturing method has not been accepted in practice since it has not been possible to solve satisfactorily certain problems which occur. It developed, for example, that the fiber guide conduit device prefabricated from the steel sheeting may deform in the diecasting tool due to the high pressure and must therefore be specially supported during the process, which is expensive. Moreover, there is the constant danger that liquid casting material may penetrate into the fiber conduit, which has a very negative effect on its surface quality.

According to German Patent Publication DE 195 11 084 A1, the fiber guide conduit device is also designed as a cold-formed steel sheeting part. However, in this device the fiber guide conduit device can be fixed in a replaceable manner in a corresponding receiving bore of a prefabricated opening-cylinder housing. A seal of the fiber guide conduit device against the opening-cylinder housing is accomplished via an O-ring seal resting on the outer circumference of the fiber guide conduit device. This known fiber guide conduit device is sealed against the conduit plate by a hose nozzle.

It has been experienced in practice that sealing problems occur with such steel sheet constructions which do not permit an orderly spinning operation.

Moreover, bipartite fiber guide conduit devices are known, e.g. from German Patent Publications DE 29 47 294 A1 and DE 39 23 060 A1 in which the fiber entry area of the fiber guide conduit device is displaceably mounted in the opening-cylinder housing. The movable arrangement of one of the fiber guide conduit parts is intended to assure a reliable seal between the two fiber guide conduit sections. However, this known patent literature does not explain how these movable fiber guide conduit parts are manufactured.

SUMMARY OF THE INVENTION

It is accordingly a basic object of the present invention to provide an improved replaceable fiber guide conduit device which addresses the problems of the previously cited state of the art.

The invention achieves this objective in an open-end spinning apparatus basically comprising a spinning housing, a spinning rotor rotatably disposed in the spinning housing, a conduit plate for closing the spinning housing, means for applying a vacuum within the spinning housing, a sliver opening device having an opening housing and an opening cylinder rotatably disposed in the opening housing, and a fiber guide conduit device connecting the sliver opening device to the conduit plate. The opening housing has a connection bore for replaceably receiving the fiber guide conduit device. According to the present invention, the fiber guide conduit device comprises a fiber guide conduit body formed as a cast element and having a foot of a circular cross section for engagement in the connection bore of the opening housing, a groove formed in the foot for receiving a first sealing element for sealing engagement with the opening housing, a position fixing element for positioning engagement with the opening housing, and a contact shoulder for supporting a second sealing element for sealing engagement with the conduit plate.

The design of the fiber guide conduit device as a cast part in accordance with the present invention has the advantage that such components are economical to manufacture, especially if rather large quantities are required. In addition, the circular cross section, at least of the foot portion of the fiber guide conduit body, has the advantage that such a component can be fixed in a "normal", that is, circular connection bore of the opening-cylinder housing. The formation of a groove into the foot portion to receive a sealing device, preferably an O-ring seal, provides a reliable seal of the fiber guide conduit device against the opening-cylinder housing.

The other sealing element supported on the contact shoulder arranged on the fiber guide conduit body surrounds, among other things, the mouth area of the fiber guide conduit body in a sealing manner and is preferably designed as a hose nozzle. This hose nozzle serves to load axially the fiber guide conduit device and to fix securely therewith in the connection bore of the opening-cylinder housing and also acts to reliably seal the fiber guide conduit device against the conduit plate.

Moreover, the position fixing device cast onto the fiber guide conduit body assures the exact maintainence of a given mounting position of the fiber guide conduit device in the opening-cylinder housing in a simple manner.

The surface of the fiber guide conduit in the fiber guide conduit body is preferably wear-protected, which renders it sturdy to a high degree. For example, the fiber guide conduit device may be coated by a suitable treatment method, e.g. by immersion into a nickel dispersion bath, with a hard protective layer. Alternatively, it may be sufficient to coat or otherwise wear-protect only the most highly stressed area of the fiber guide conduit, e.g., the portion located in the entrance area of the fiber guide conduit on the so-called fiber tear-off edge.

The geometric configuration of the fiber guide conduit is preferably selected such that the central axis of the conduit extends in a straight line and such that the fiber guide conduit has essentially the same height over its entire conduit length. Such a design of the fiber guide conduit device has the result that the individual fibers opened from the sliver during its transport through the fiber guide conduit are hardly deflected and are therefore advantageously fed into the spinning rotor in an individualized and stretched state.

The improvements of the present invention serve to optimize the transport of individual fibers through the fiber guide conduit and have, on the whole, a positive effect on the fiber infeed, which can be readily recognized in the improved yarn values which can be attained with the apparatus of the invention.

Further details, features and advantages of the present invention will be understood and explained with reference to an exemplary embodiment described hereinbelow and illustrated in the accompanying drawings.

DESCRIPTION OF THE PREFERRED EMBODIMENT

Figure 1:
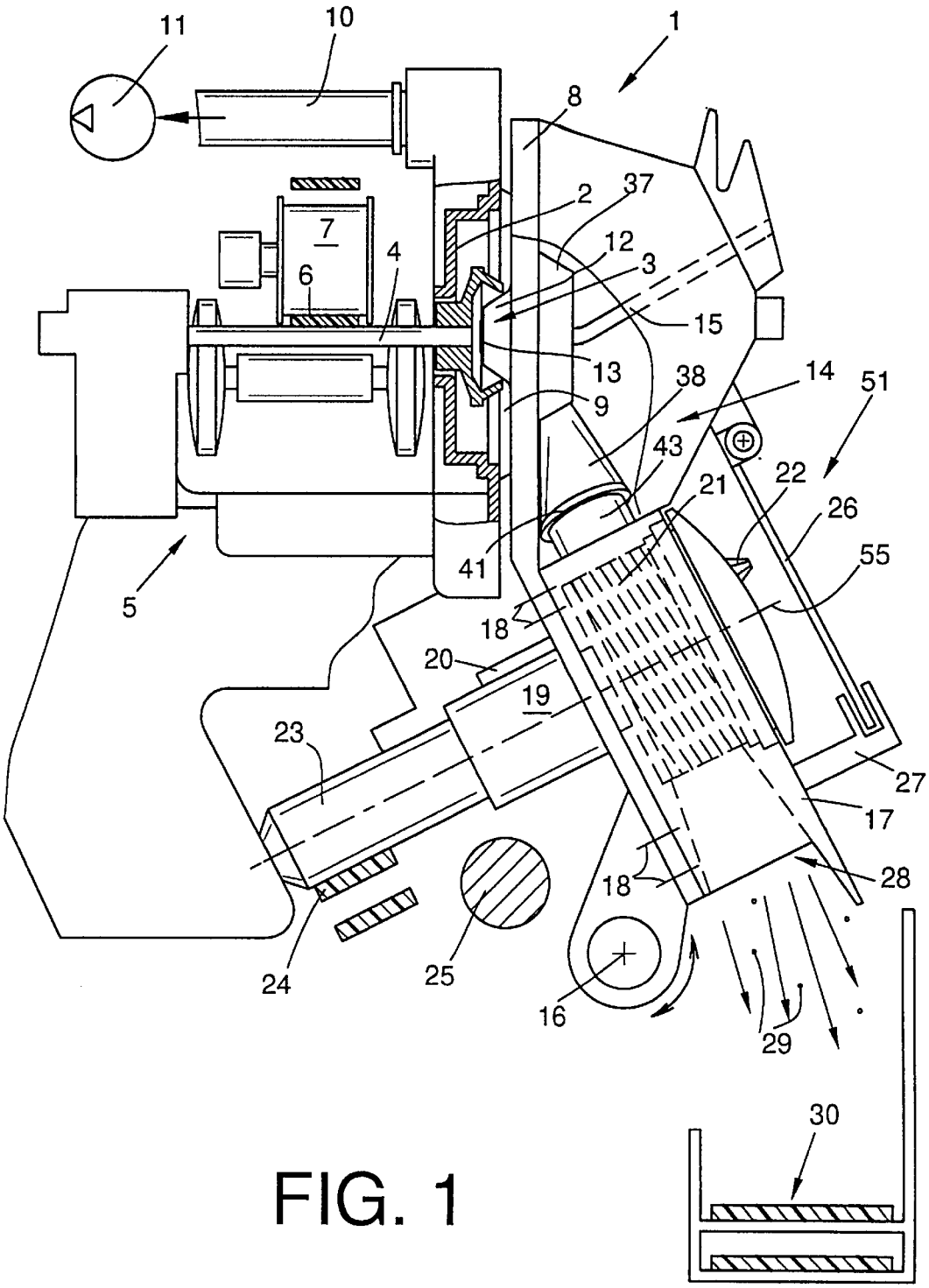
FIG. 1 is a side elevational view, partially in vertical cross-section, of an open-end spinning apparatus with a fiber guide conduit device according to the present invention connected between a sliver opening device and a conduit plate.

Referring now to the accompanying drawings and initially to FIG. 1, an open-end rotor spinning apparatus 1 is shown to basically comprise, as is known, a rotor housing 2 in which a spinning rotor 3 rotates at a high speed. The open-end spinning apparatus 1 comprises one spinning position of an open-end spinning machine (not otherwise shown) having a plurality of such spinning apparatus aligned along the length of the machine. The spinning rotor 3 is supported by a rotor shaft 4 in the nip of a support disk bearing assembly 5 and is driven by a tangential belt 6 which runs the length of the machine and is held against the shaft 4 by a pressure roller 7.

The rotor housing 2 is open toward the front of the spinning apparatus (rightwardly as viewed in FIG. 1) and is closed during operation by a pivotably mounted cover element 8 comprising a conduit plate 37 with a seal 9. In addition, the rotor housing 2 is connected via an appropriate suction line 10 to a vacuum source 11 which generates a vacuum in the rotor housing 2 necessary for spinning operation.

An extension of the conduit plate 37, commonly referred to as a conduit plate adapter 12, is arranged in a receiving opening (not shown in more detail) of the conduit plate 37, preferably in a replaceable manner. The conduit plate adapter 12 is connected with a yarn withdrawal nozzle 13 as well as the mouth area of a fiber guide conduit device 14. The yarn withdrawal nozzle 13 opens into a yarn withdrawal tube 15 to remove yarn from the rotor 3 as the yarn is spun.

An opening-cylinder housing 17 is fixed on the cover element 8, which is mounted so that it can pivot as aforementioned in a limited fashion about a pivot axis 16, e.g. via screw bolts 18 as well as appropriate fitting means. The cover element 8 comprises rear bearing brackets or pads for mounting an opening cylinder 21 and/or a sliver feeding cylinder 22. The opening cylinder 21 is rotatably driven via a shaft 23 by a traveling tangential belt 24 running the length of the machine, whereas the drive of the sliver feeding cylinder 22 preferably takes place via a worm gear arrangement (not shown) connected to a drive shaft 25 also running the length of the machine. The sliver feeding cylinder 22 delivers a sliver from a storage can (not shown) to the opening cylinder 21 which, in turn, opens the sliver into individual fibers and directs the sliver into the fiber conduit device 14 for transport to the conduit plate 37 and then into the rotor 3 for spinning.

The opening-cylinder housing 17 has a soil discharge opening 28 at its downwardly facing side arranged behind the sliver feeding cylinder 22 as viewed in the direction of rotation of the opening cylinder 21. Soil particles 29 released from the sliver as part of the opening operation of the opening cylinder 21 are directed via this soil discharge opening 28 onto a soil removal device schematically shown at 30.

Figure 2:
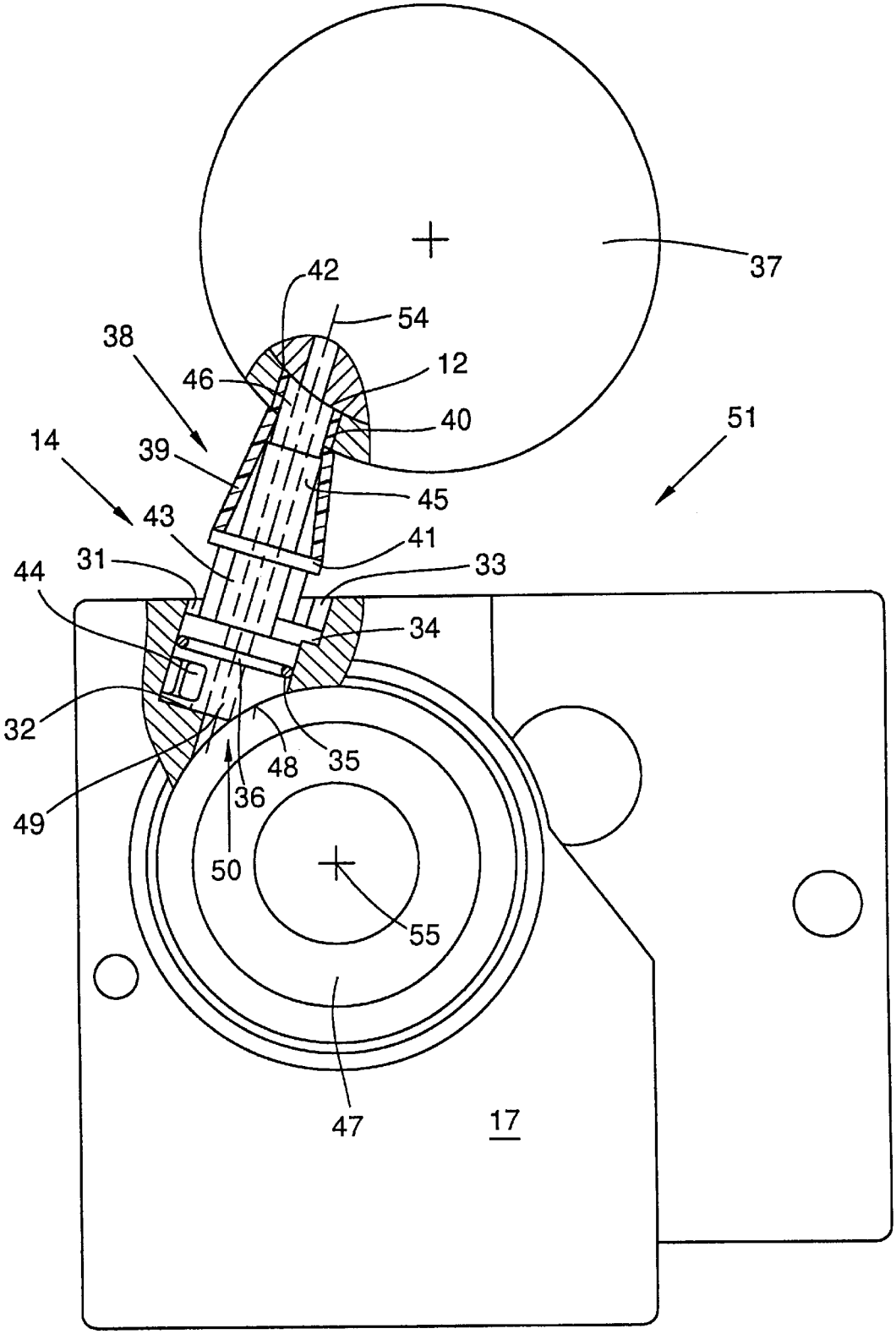
FIG. 2 is a front elevational view, partially in cross-section, of the opening-cylinder housing and the adjacent fiber guide conduit device of the open-end spinning apparatus of FIG. 1.

FIG. 2 shows the opening-cylinder housing 17 in a front view and, in particular, depicts the fiber guide conduit device 14 fitted into a receiving bore 31 formed in the opening-cylinder housing 17. As is shown, the connection bore 31 has a stop shoulder 32 on which the inserted foot 44 of the fiber guide conduit device 14 rests. The connection bore 31 also has a lateral recess 33 which receives a position fixing device 34 cast on fiber guide conduit body 43. Moreover, the fiber guide conduit device 14 is sealed against the receiving bore 31 of the opening-cylinder housing 17 by an O-ring seal 35 positioned in a corresponding groove 36 formed in the fiber guide conduit foot 44.

The fiber guide conduit device 14 is sealed against the conduit plate 37 via a hose nozzle 38 which comprises a pressure transfer section 39 and a sealing section 40. The hose nozzle 38 is clamped by its pressure transfer section 39 between the conduit plate 37 and a contact shoulder 41 on the fiber guide conduit body 43 and as a result fixes the fiber guide conduit device 14 in the connection bore 31 of the opening-cylinder housing 17. The sealing section 40 of the hose nozzle 38 surrounds a cylindrical mouth area 46 of the fiber guide conduit body 43 and engages into a bore 42 in the conduit plate 37 such that the fiber guide conduit device 14 is reliably sealed against the conduit plate 37.

Figure 3:
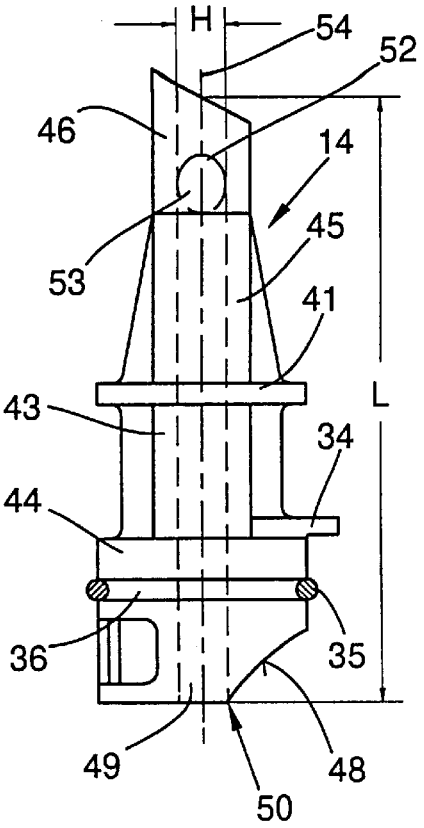
FIGS. 3–6 are more detailed elevational views of the fiber guide conduit device of the present invention shown in FIGS. 1 and 2.
Figure 6:
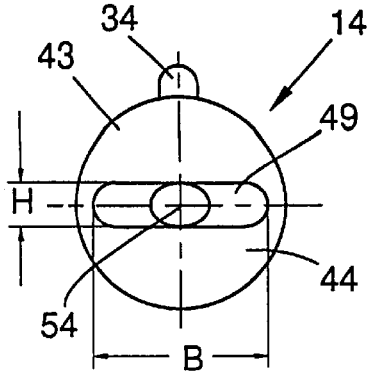
Figure 5:
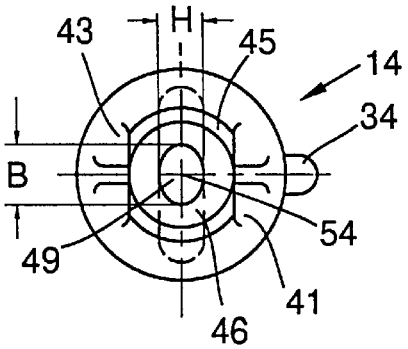
Figure 4:
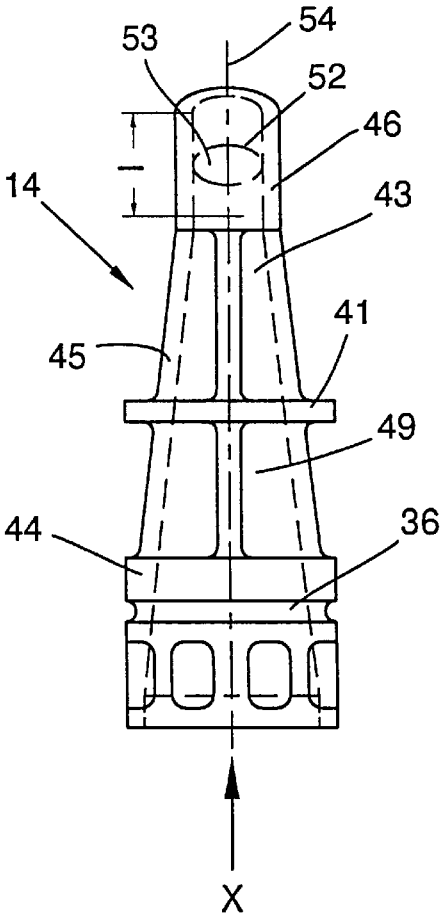

FIGS. 3 to 6 show the fiber guide conduit device 14 of the invention in greater detail. FIG. 3 is a side view of the fiber guide conduit device 14 depicting a fiber guide conduit or passageway 49 extending through the interior of the fiber guide conduit body 43. As can be seen, the fiber guide conduit 49 has a central axis 54 extending in a straight line. Moreover, the fiber guide conduit body 43, as viewed along its length, basically has a lower foot portion 44 which is circular in cross section, a central section 45 which is partially conical, and an upper cylindrical mouth area 46.

The groove 36 for receiving the O-ring seat 35 is formed into the foot 44. In addition, the foot 44 is partially truncated by a concave rounded-off section 48 conforming to the opening cylinder carrier 47. This rounded-off section 48 forms a fiber tear-off edge 50 in the area of the fiber guide conduit 49. The ratio of the cross-sectional width B to the cross-sectioned height H of the fiber guide conduit 49 is approximately 3:1 in the area of the fiber tear-off edge 50, that is, in the entry area into the conduit 49, and tapers conically in the widthwise dimension B toward the opposite mouth 46 of the conduit 49 (see FIGS. 4 and 6) while the height H of the fiber guide conduit 49 remains essentially constant from the entry area 50 to the mouth 46, aside from a slight tapering occasioned by the manufacture, as can be seen e.g. from FIG. 3.

The position fixing device 34 of the fiber guide device 14 is formed onto the fiber guide conduit body 43 above the foot 44, and engages, as already described previously, into the corresponding recess 33 of the connection bore 31 in the opening-cylinder housing 17 and thereby fixes the exact mounting position of the fiber guide conduit 43. As thus installed, the interior widthwise extent B of the fiber guide conduit 49 is oriented parallel to the rotational axis 55 of the opening cylinder 21.

The contact shoulder 41 of the fiber guide device 14 is located in a central area 45 of the fiber guide conduit body 43 on which shoulder 41 the hose nozzle 38 rests by its pressure transfer section 39 in the mounted state, as described. The fiber guide conduit 49 tapers conically in its widthwise dimension along the central area 45, as mentioned above.

The exterior of the mouth 46 of the fiber guide device 14 is cylindrical and the section 52 of the fiber guide conduit within the mouth 46 has an inside cross-section which is substantially constant over the entire length of the fiber guide conduit section 52, which constitutes approximately one fifth of the entire length L of fiber guide conduit 49. Thus, the fiber guide conduit section 52 has a steadying or stabilizing effect on the spinning fibers being fed into the spinning rotor. The height/width ratio of the fiber guide conduit section 52 is between 1:1.3 and 1:1.4. Fiber guide conduit 49 also has its minimal inside cross section 53 in the area of fiber guide conduit section 52, which inside cross section 53 is between 23 $mm^2$ and 28 $mm^2$.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning apparatus comprising a spinning housing, a spinning rotor rotatably disposed in the spinning housing, a conduit plate for closing the spinning housing, means for applying a vacuum within the spinning housing, a sliver opening device having an opening housing and an opening cylinder rotatably disposed in the opening housing, and a fiber guide conduit device connecting the sliver opening device to the conduit plate, the opening housing having a connection bore for replaceably receiving the fiber guide conduit device, and the fiber guide conduit device comprising a fiber guide conduit body formed as a cast element, the fiber guide conduit body having a foot of a circular cross section for engagement in the connection bore of the opening housing, a groove formed in the foot for receiving a first sealing element for sealing engagement with the opening housing, a position fixing element for engagement with the opening housing for fixing the position of the fiber guide conduit relative thereto, and a contact shoulder for supporting a second sealing element for sealing engagement with the conduit plate.

2. The open-end spinning apparatus according to claim 1, wherein the first sealing element comprises an O-ring seal and the second sealing element comprises a hose nozzle.

3. The open-end spinning device according to claim 1, wherein the fiber guide conduit body of the fiber guide conduit device defines a fiber guide conduit therein having a wear-protected service.

4. The open-end spinning device according to claim 3, wherein the fiber guide conduit body comprises a fiber tear-off edge and the wear-protected surface of the fiber guide conduit is located at least in the area of the fiber tear-off edge.

5. The open-end spinning device according to claim 1, wherein the fiber guide conduit has a linear central axis and has transverse height which is essentially constant over the length of the fiber guide conduit.

6. The open-end spinning device according to claim 5, wherein the fiber guide conduit has a conduit section of a generally constant cross sectional area.

7. The open-end spinning device according to claim 5, wherein the length of the conduit section is approximately one fifth of the total length of the fiber guide conduit.

8. The open-end spinning device according to claim 7, wherein the conduit section has a ratio of height to width of between 1:1.3 and 1:1.4.

9. The open-end spinning apparatus according to claim 1, wherein the fiber guide conduit body defines an interior fiber guide conduit including a fiber guide conduit section extending within the foot, the inside cross section of the fiber guide conduit section is between 23 $mm^2$ and 28 $m^2$.

10. The open-end spinning apparatus according to claim 1, wherein the fiber guide conduit body defines an interior fiber guide conduit having a widthwise extent oriented parallel to the rotational axis of the opening cylinder.

* * * * *